United States Patent [19]

Asp et al.

[11] 4,134,328

[45] Jan. 16, 1979

[54] DEVICE FOR A MISSILE

[75] Inventors: Börje Asp; John-Erik Martinsson, both of Karlskoga, Sweden

[73] Assignee: Aktiebolaget Bofors, Bofors, Sweden

[21] Appl. No.: 770,341

[22] Filed: Feb. 22, 1977

[30] Foreign Application Priority Data

Aug. 25, 1975 [SE] Sweden ..... 7509416

[51] Int. Cl.[2] ..... F41F 3/04

[52] U.S. Cl. ..... 89/1.817

[58] Field of Search ..... 89/1.817, 1.816, 1.810, 89/1.8

[56] References Cited

U.S. PATENT DOCUMENTS

| | | | |
|---|---|---|---|
| 2,609,730 | 9/1952 | Bergström | 89/1.817 |
| 2,816,483 | 12/1957 | Johnston | 89/1.817 |
| 3,089,389 | 5/1963 | Andrews et al. | 89/1.816 |
| 3,160,061 | 12/1964 | Moy | 89/1.816 |
| 3,295,411 | 1/1967 | Lehmann | 89/1.810 |
| 3,499,364 | 3/1970 | D'Ooge | 89/1.810 |

FOREIGN PATENT DOCUMENTS

| | | | |
|---|---|---|---|
| 2217657 | 9/1974 | France | 89/1.817 |

*Primary Examiner*—David H. Brown

*Attorney, Agent, or Firm*—Pollock, Vande Sande & Priddy

[57] ABSTRACT

The present invention relates to a missile launching assembly, and in particular to an apparatus for automatically separating a front cover of a missile launching tube with a reverberating shock wave created by missile propellants striking a rear cover of the tube, thereby avoiding direct contact between the front cover and the missile.

7 Claims, 4 Drawing Figures

DEVICE FOR A MISSILE

The present invention relates to a device for automatically separating the front cover of a missile launching tube in such a way that mechanical contact between the missile and the cover is avoided when the missile is launched from the tube.

In order to eliminate the influence of external sources of disturbance, it is known to store ammunition in containers. If the container subsequently is employed as a launching tube for some kind of rocket motor propelled projectile, then the tube must be sealed at both ends. If the weapon must be disposed in a ready for firing position for some time, it is often necessary to provide the storing tube with sealing assembly which protects the projectile from rain and snow.

The sealing assembly is positioned at both ends of the launching tube and is usually in the shape of covers which are removed at the instant of launch. To minimize the time between sight of target and firing it is required that the covers be automatically removed. The conventional way to perform this is to use the propellant gases from the rocket motor to blow away the rear cover and to let the missile itself push away the front cover. Problems arise when a missile's foldable wings, rudder or other easily damaged structure contacts the front cover or parts of it.

Heretofore known devices relating to covers which are pushed away by the missile itself are based either on the principle of frangible material which is broken by the missile itself, or on the membrane principle, whereby the missile penetrates a thin membrane. A common drawback for these previously known devices is that the missile may still come into mechanical contact with the cover or parts of it causing extensive damage. Covers of the membrane type have the additional drawback of failing to resist pressure differences of any great extent.

An object of the present invention is to provide a device which eliminates the above mentioned drawbacks. A particular feature of the present invention is that the front cover is separated from the launching tube by a pressure wave established in the launching tube when the propellant gases from the rocket motor hit the rear cover of the tube. A further feature is structure for changing the direction of motion of the front cover after the separation so that the front cover moves along a trajectory that deviates from the launching direction.

The structure for changing the direction of motion preferably consists of a hook which has one part pivotally secured to the central part of the cover and the other part removably attached to the wall of the launching tube.

Figure 1:
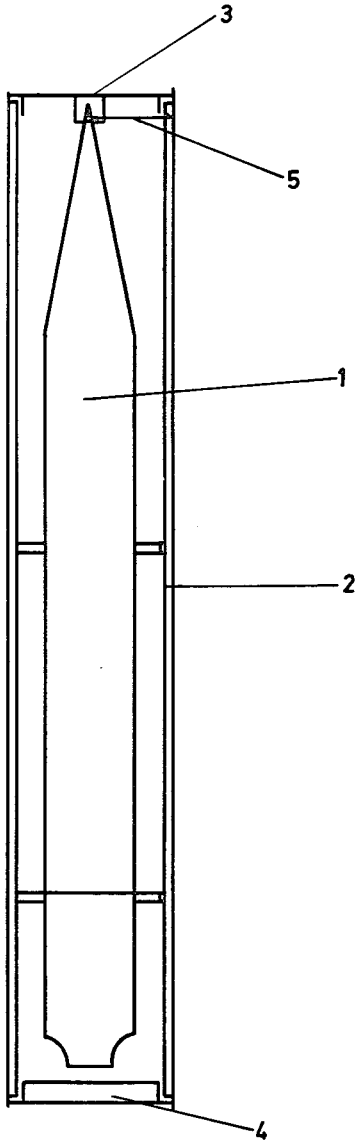
Figure 2:
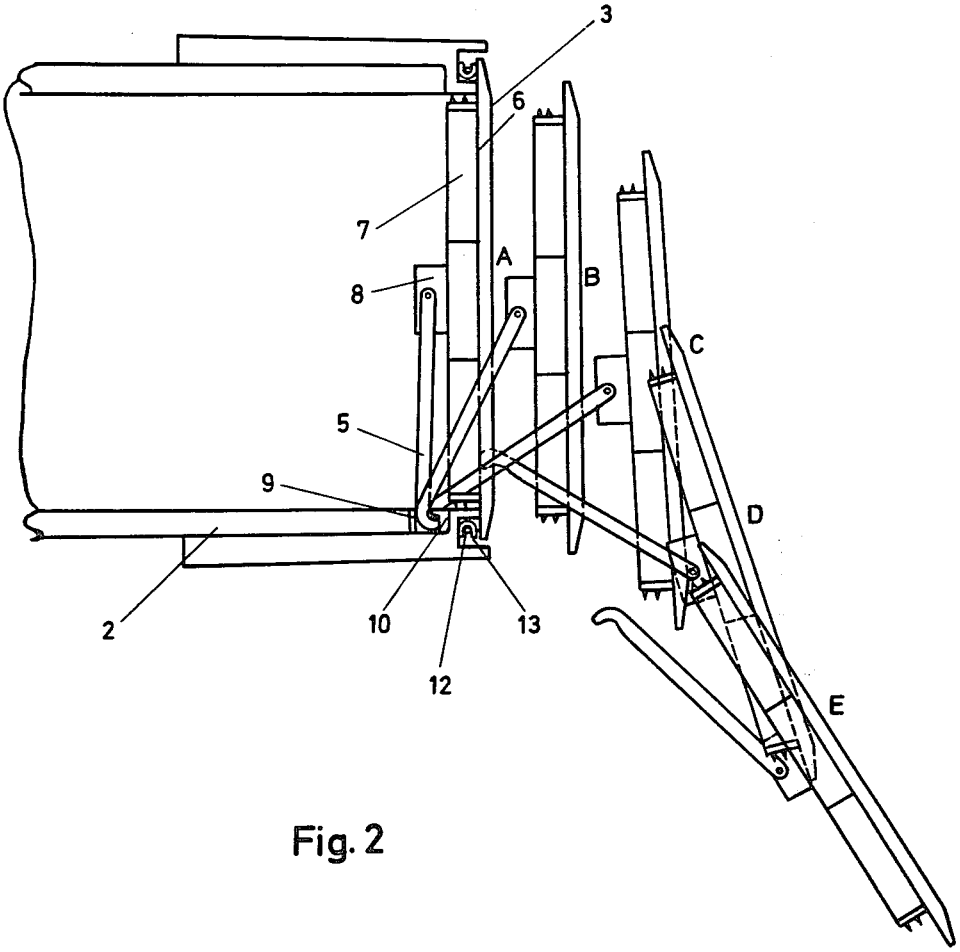
Figure 3A:
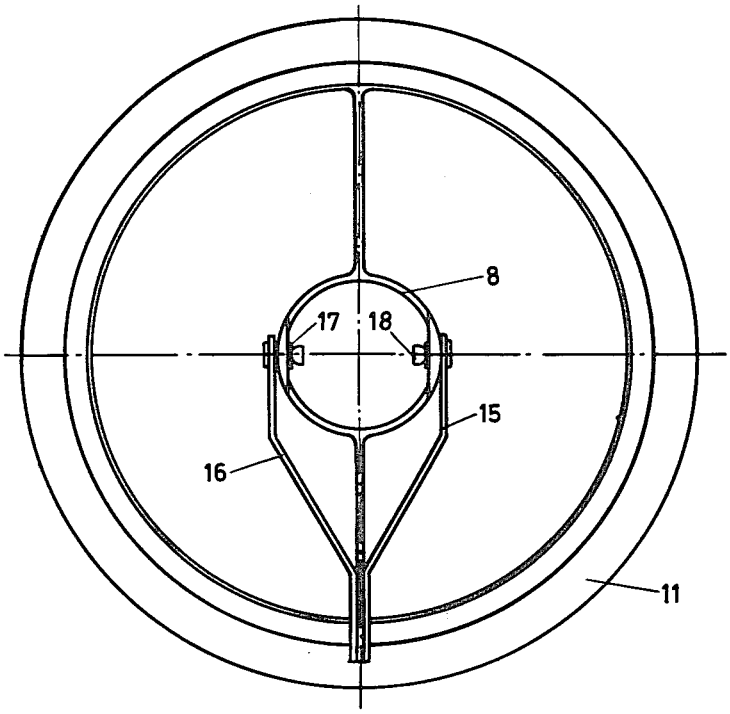
Figure 3B:
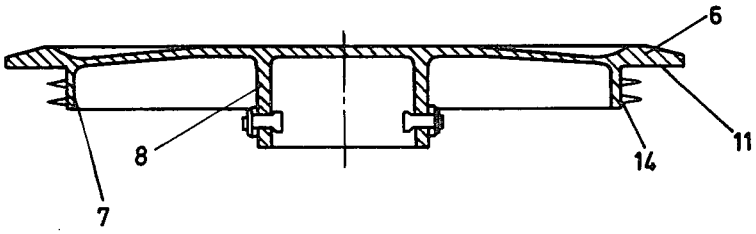

A preferred embodiment of the present invention will be described in more detail with reference to the attached drawings, in which FIG. 1 is a view of a missile disposed in a launching tube pair of sealing covers, FIG. 2 is a view showing the motion of the front cover relative to the launching tube during separation, FIG. 3*a* is a view of the front cover from below and FIG. 3*b* is a cross-sectional view of the front cover.

Referring to the drawings, there is illustrated in a schematic view a missile 1 disposed in a cylindrical launching tube 2, which subsequently is employed as a container for the missile during storing and transport. The launching tube 2 is provided with sealing assembly which consists of a front cover 3 and a rear cover 4 which prevent the influence of such as dust, rain and snow on the missile.

When the missile is ready for launching, the rocket motor is provided with an ignition pulse. When the resulting pressure in the motor has reached a certain level, the nozzle plug is broken and propellent gases from the rocket motor flow out through the nozzle striking the rear cover 4 and establishing a pressure wave which reverberates through the air in the tubular space between the inner wall of the launching tube and the missile 1. When the pressure wave reaches the front cover, energy is transferred from the pressure wave to the front cover 3 resulting in the cover 3 separating from the launching tube 2. For a short time the cover travels in the launching direction of the missile 1 with an acceleration greater than the missile 1.

As shown in FIG. 2, the front cover 3 is initially connected with the launching tube 2 via a pivoted hook 5 arranged whereby the cover 3 changes its direction of motion after separation from the tube. This change of direction of motion continues until the hook 5 has been moved to an angle releasing it from the wall of the launching tube 2. The front cover 3 then continues in the direction deviating from the launching direction of the missile 1 allowing the missile 1 to passes the cover 3 without coming into mechanical contact therewith.

In FIG. 2, the cover 3 is illustrated in five different positions during its trajectory, which positions are indicated by A, B, C, D and E respectively. In its initial position A the front cover 3 provides a front end sealing for the launching tube 2. The cover 3 consists of a part 6 in the form of a circular disc which is in contact with the end surface of the tube and a tubular part 7 which extends into the tube 2 and is of a diameter which is slightly less than the inner diameter of the tube 2. Between the cover 3 and the launching tube 2 seal rings are arranged and will be more fully described in connection with FIG. 3. The hook 5 that connects the cover 3 with the launching tube 2 has one part pivotally connected to the central part 8 of the cover 3 which forces the cover 3 to move in a direction paralled to the tube 2 during initial separation. The other end of hook 5 is shaped as a claw and is loosely recess 9 in the wall of the tube 2. The clawshaped part cooperates with a hold 10 in the recess so that the hook 5 is locked and only capable of performing a rotary motion around the claw shaped part until it a certain angle of rotation is achieved, which release the claw from the hold 10 in the recess 9 resulting in the cover 3 changing its direction of motion. In the positions B and C the cover essentially follows a circular trajectory until the hook 5 is released from the hold 10. Then the cover 3 continues in a straight line direction deviating from the direction of launching, see the positions indicated by D and E.

The velocity of the front cover 3 is an important parameter and the value depends on the weight of the cover 3 and the strength of the pressure wave. The strength of the pressure wave depends on weight, tensile properties and geometrical properties of the rear cover 4. The weight and properties of the rear cover 4 may be similar to the front cover 3.

FIGS. 3*a* and *b* show more in detail the underside and a cross-sectional view, respectively, of the front cover 3. The disc-shaped part 6 of the front cover 3 consists of a plane circular sealing surface in contact with the end surface of the tube 2 and a sealing ring 12 disposed in a recess 13 in the end surface of the tube 2 which seals axially against the cover 3 as it is squeezed against the sealing ring 12, by means of an end case (not shown). The cover 3 is also sealed radially relative to the tube 2 by a rubber ring 14 fixed by cement on the outer surface of the tubular part 7. The rubber ring 14 serves as an active sealing when the weapon is ready for launching, for instance on a base, with the end covers removed. The central part 8 of the cover includes a smaller diameter portion concentric with the tubular part 7. The hook 5 includes two legs 15, 16 which are pivoted on rivets 17, 18 mounted in opposite reinforced parts in the wall of the tubular part 8.

Although a presently preferred embodiment of this invention has been disclosed hereinabove, such description is intended to be illustrative only, and the true scope of the present invention is to be defined only by the appended claims.

We claim:

1. Launch support apparatus for a gas powered missile device, said apparatus comprising:

a cylindrically shaped, hollow launch tube including first and second open end portions;

a front cover detachably enclosing said first end portion of said tube; and means including a rear cover detachably engaging the launch tube for directing a pressure wave generated by said device against said front cover to separate said front cover from said tube and thereby prevent direct contact between said front cover and said device as said device exits through said first opening.

2. An apparatus according to claim 1, wherein said means comprises a rear cover member detachably engaging the second end portion of said tube and positioned in a direct exhaust path of said gas powered device.

3. Launch support apparatus for a gas powered missile device, said apparatus comprising:

a cylindrically shaped, hollow launch tube including first and second open end portions;

a front cover member detachably enclosing the first end portion of said tube;

means including a rear cover detachably engaging the launch tube for directing a pressure wave generated by said device against said front cover to separate said front cover from contact with said tube; and guide means engaging said front cover and said tube to force said front cover to move along a trajectory deviating from a longitudinal axis extending through said launch tube.

4. An apparatus according to claim 3, wherein said means comprises a rear cover detachably engaging the second end portion of said tube and positioned in a direct exhaust path of said gas powered device.

5. An apparatus according to claim 3, wherein said guide means comprises a bifurcated hook member including a first end portion pivotally attached to a central boss portion formed on said front cover and extending into said launch tube, said hook member further including a claw shaped end portion pivotally engaging a recess formed in an inner wall surface of said tube.

6. An apparatus according to claim 5, wherein said claw portion of said hook member rotates within said recess as said front cover initially separates from said tube forcing said front cover to move in a trajectory deviating from said longitudinal axis.

7. An apparatus according to claim 6, wherein said hook member rotates a certain degree and then detaches from said tube with said front cover continuing in a path deviating from said axis.

* * * * *